United States Patent [19]

Donofrio et al.

[11] Patent Number: 5,065,071

[45] Date of Patent: Nov. 12, 1991

[54] MONOCHROME CRT WITH INTERFERENCE FILTER HAVING FILTER LAYER WITH REDUCED TRANSMISSION AND PROJECTION COLOR TV INCORPORATING SAME

[75] Inventors: Robert L. Donofrio, Saline, Mich.; André A. Van der Voort, Son en Breugel, Netherlands

[73] Assignee: North American Philips Corporation, New York, N.Y.

[21] Appl. No.: 459,886

[22] Filed: Jan. 2, 1990

[51] Int. Cl.[5] ..... H01J 29/89; H01J 29/28

[52] U.S. Cl. ..... 313/474; 313/112; 313/466; 358/73; 427/68

[58] Field of Search ..... 358/60, 64, 73, 231, 358/237; 313/112, 466, 474; 427/68

[56] References Cited

U.S. PATENT DOCUMENTS

| | | | |
|---|---|---|---|
| 4,634,926 | 1/1987 | Vriens et al. | 358/253 X |
| 4,683,398 | 7/1987 | Vriens et al. | 358/237 X |
| 4,804,884 | 2/1989 | Vriens et al. | 358/237 X |
| 4,914,510 | 4/1990 | Brennesholtz et al. | 358/64 X |
| 4,914,511 | 4/1990 | Brennesholtz et al. | 358/64 X |
| 4,937,661 | 6/1990 | Van der Voort | 358/64 X |

*Primary Examiner*—Kenneth A. Wieder
*Assistant Examiner*—Glenn W. Brown
*Attorney, Agent, or Firm*—John C. Fox

[57] ABSTRACT

The bulls-eye effect produced by projection television cathode ray display tubes with convexly curved faceplates and multi-layer interference filters is compensated by increasing the optical absorption of one of the filter layers having a decreasing center-to-edge thickness gradient. Since the layer is thicker in the center, more attenuation of the light output occurs there than at the edges of the display window, resulting in improved luminance uniformity of the display.

18 Claims, 3 Drawing Sheets

FIG. 1
PRIOR ART
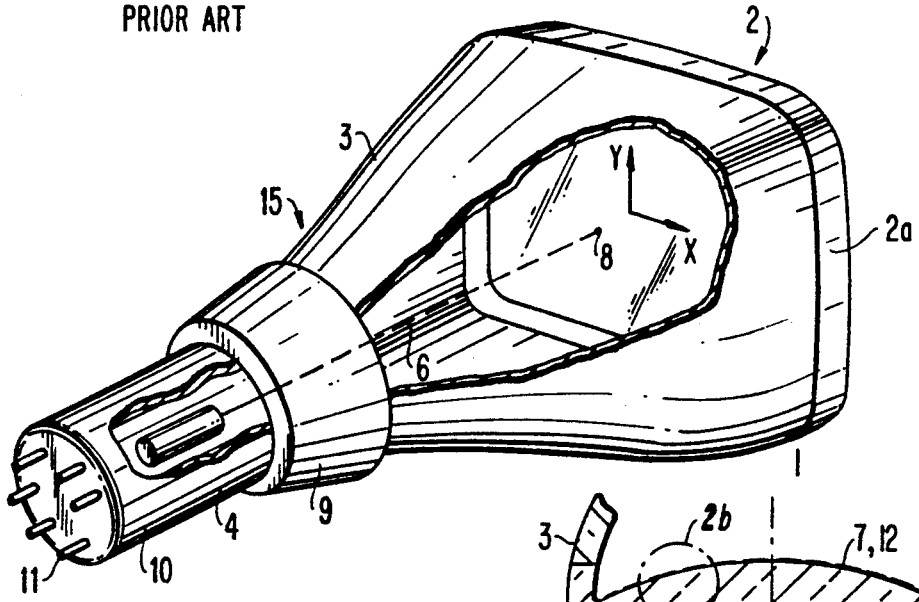
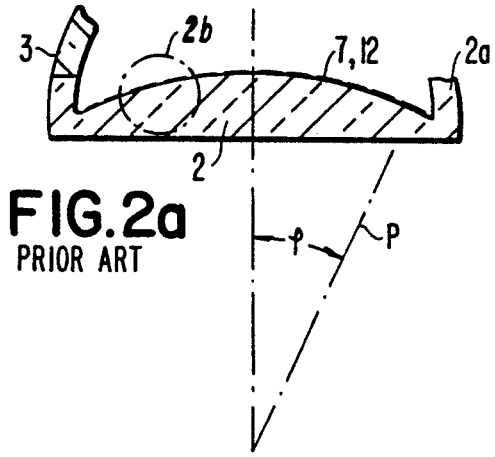
FIG. 2a
PRIOR ART
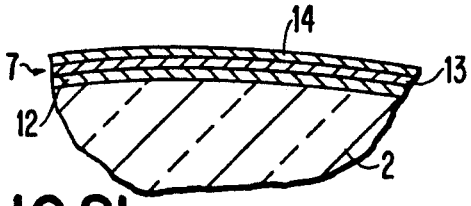
FIG. 2b
PRIOR ART
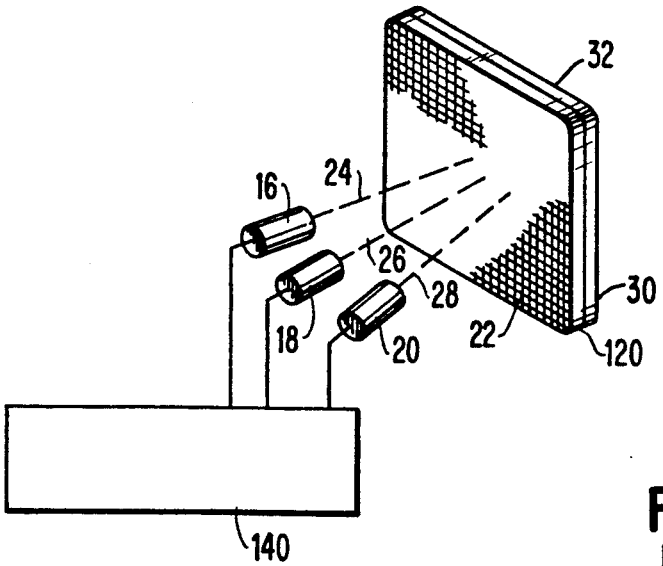
FIG. 5
PRIOR ART

MONOCHROME CRT WITH INTERFERENCE FILTER HAVING FILTER LAYER WITH REDUCED TRANSMISSION AND PROJECTION COLOR TV INCORPORATING SAME

CROSS REFERENCE TO RELATED APPLICATIONS

Copending U.S. patent applications Ser. No. 289,338, now U.S. Pat. No. 4,914,510 and Ser. No. 288,833, now U.S. Pat. No. 4,914,511 filed concurrently on Dec. 23, 1988, relate to CRTs with interference filters for projection television in which the luminance gradient and the number of filter layers respectively, are altered to improve white field uniformity of the projection image. Copending U.S. patent application Ser. No. 459,915, filed concurrently herewith, relates to such CRTs in which the display window is altered to improve luminance uniformity.

BACKGROUND OF THE INVENTION

This invention relates to color projection television (PTV) display devices using monochrome cathode ray tubes (CRTs), and more particularly relates to such devices using such tubes incorporating interference filters on the inner surface of the display window.

Monochrome CRTs for color PTV each employ a single electron gun mounted in the neck of the tube to focus a single electron beam on the fluorescent display screen of the tube. A deflection yoke surrounding the neck of the tube, and associated electronic circuitry, cause the beam to scan the screen as well as to vary in intensity in response to a video signal to produce a monochrome display image.

In color PTV, three such displays, each in one of the primary colors red, blue and green, are superimposed on a large projection screen to produce a full color display image. Because the images on the individual tube screens are not viewed directly, but are magnified and projected by a system of projection lenses, the individual cathode ray tubes are driven at higher loads than would be encountered for direct view tubes, in order to produce a full color display of acceptable brightness.

Projection tubes having a multilayer interference filter on the display window are described in U.S. Pat. No. 4,634,926, assigned to U.S. Philips Corporation. The filter, herein referred to as a shortwave pass (SWP) filter, is composed of alternating layers of materials of high and low refractive index. The filter is designed to result in a marked increase in luminous efficiently of the tube in the forward direction, as well as improved chromaticity and contrast. Even further improvements are provided, especially in light gain in the corners of the display screen, by combining such an interference filter with an inwardly or convexly curved display window, as provided in U.S. Pat. No. 4,683,398, also assigned to U.S. Philips Corporation.

In these tubes, the interference filter is deposited directly upon the inner surface of the display window, and the luminescent phosphor screen is deposited on the interference filter. The filter is typically composed of from 14 to 20 layers, each having a thickness of about one quarter of the central wavelength of the filter.

Such tubes with interference filters, while exhibiting a marked increase in luminous efficiency in the forward direction, as well as improved chromaticity and contrast, also exhibit greater luminance in the center than at the edges of the display, sometimes referred to herein as center-to-edge luminance gradient.

This center-to-edge luminance gradient, also referred to as the "bulls-eye effect", is due not only to the intentional design of the filter to concentrate the luminous output in the forward direction, but also to the unintentional decrease in thickness of the filter from the center toward the edges of the display window, due in large part to the shadowing effect of an upstanding peripheral sidewall or skirt, which extends rearward from the display window and joins the display window to the funnel-shaped portion of the CRT envelope.

This bulls-eye effect is partially alleviated by the use of the convexly curved inner surface of the display window, which tends to direct most of the light into the projection lens. However, since the radius of curvature of this inner surface is not an exact match for that of the projection lens, the bulls-eye effect cannot be completely compensated by this technique.

OBJECTS AND SUMMARY OF THE INVENTION

It is a principal object of the invention to improve the luminance uniformity of a monochrome cathode ray tube having a display window with multilayer interference filter carried on its inner surface.

It is another object of the invention to improve the luminance uniformity of such a tube with a convexly curved inner surface of the display window.

It is another object of the invention to provide a color projection television display device incorporating one or more of such monochrome cathode ray tubes with improved luminance uniformity.

In accordance with the invention, the luminance uniformity of a monochrome cathode ray tube having a display window carrying a multilayer interference filter on its inner surface, is improved by providing one or more layers of the multilayer interference filter with a center-to-edge thickness gradient in which the thickness decreases from the center to the edge of the display window, and with an optical absorption for at least the wavelengths of radiation corresponding to the luminescent output of the tube greater than that of the remaining layers, thereby providing greater attenuation of the emitted radiation in the center and progressively less attenuation toward the edges of the display window, to at least partially compensate for the bulls-eye effect.

According to another aspect of the invention, a method of producing such a CRT comprises: depositing one or more layers of the multilayer interference filter with a center-to-edge thickness gradient in which the thickness decreases from the center to the edge of the display window; and increasing the optical absorption of such layers relative to the remaining layers, thereby providing greater attenuation of the emitted radiation in the center and progressively less attenuation toward the edges of the display window to at least partially compensate for the bulls-eye effect.

In a preferred embodiment of the invention, the center-to-edge thickness gradient of the filter layer is achieved by shadowing the peripheral regions of the display window of the CRT with a skirt during deposition of the layer.

In another preferred embodiment, the multilayer interference filter layers consist of metallic oxides, and the optical absorption of the one or more layers is increased by reducing the oxygen content of the layer.

In another preferred embodiment of the invention, the display window has a convexly curved inner surface.

In accordance with another aspect of the invention, a multi-tube color projection television display device incorporates at least one such CRT with improved luminance uniformity.

BRIEF DESCRIPTION OF THE DRAWINGS

FIG. 1 is a perspective view, partly broken away, of a projection television display tube of the prior art;

FIG. 2*a* is a diagrammatic cross-section of a portion of the front of the display tube of FIG. 1, showing the display window bearing a luminescent screen and interference filter on its inner convexly curved surface;

FIG. 2*b* is a detailed cross-section of a portion of the window, screen and filter of FIG. 2*a;*

FIG. 5 is a diagrammatic representation of a three-tube color projection television incorporating at least one display tube of the invention.

DESCRIPTION OF THE PREFERRED EMBODIMENTS

Figure 3:
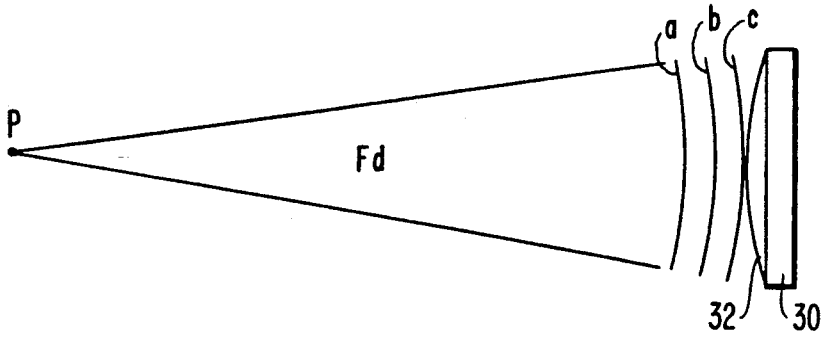
FIG. 3 is a diagrammatic view of one arrangement for depositing a filter layer on a flat display window in accordance with the invention.

FIG. 1 is a perspective view, partly broken away, of a projection television display tube 15 according to the prior art. The tube comprises a glass envelope 1 which consists of a convexly curved display window 2, having a skirt 2*a*, a funnel 3, and a neck 4, within which is mounted an electron gun 5 for generating an electron beam 6. The electron beam is focussed on curved display screen 7, on the inside of display window 2, to form a spot 8. The electron beam 6 is deflected over the display screen 7 in two mutually perpendicular directions along X and Y axes (sometimes referred to as the major and minor axes, respectively), by means of a system of deflection coils 9. Electrical connection to gun 5 is provided through base 10 with connection pins 11.

FIG. 2*a* is a partial sectional view of the funnel 3, the curved display window 2, the display screen 7, and the multi-layer interference filter 12. The inner surface of the display window is preferably convexly curved to as near spherical as possible, but may also be of aspherical shape. As seen in more detail in FIG. 2*b*, the display screen 7 consists of a layer of luminescent material (phosphor) 13 and a thin aluminum film 14, overlying filter 12.

The details of the filter design are known from the teachings of U.S. Pat. Nos. 4,683,398 and 4,634,926, cited above, and are therefore not a necessary part of this description. Briefly however, the filter is a short wave pass (SWP) filter comprising alternating layers of low and high refractive index materials, such as $SiO_2$ and $TiO_2$, having refractive indices of 1.44 and 2.35, respectively. These layers are typically formed by vapor deposition directly on the inner surface of the display window until a total of from 14 to 20 layers have been deposited, increasing numbers of layers resulting in increased definition of the cut-off wavelength of the filter.

In addition to such a SWP filter, the interference filter may also be in the form of a bandpass (BP) filter in accordance with the teachings of copending patent application Ser. No. 217,259, filed July 11, 1988, now U.S. Pat. No. 4,937,661, assigned to North American Philips Corporation.

As already stated, the interference filters are designed to concentrate the luminous output of the CRT in a forward direction, in order to increase the luminance of the projection display, but also resulting in a luminance non-uniformity called the bulls-eye effect. This bulls-eye effect is worsened in the case of a display window with a skirt, due to the shadowing effect of the skirt during the deposition of the filter layers, causing the layers to become thinner toward the edges of the display window. While the convex curvature of the inner surface of the display window is designed to compensate for this bulls-eye effect, it is not completely effective, due in great part to the mismatch of its curvature with that of the projection lens.

According to the invention, further compensation for the bulls-eye effect in such tubes with flat or curved display windows is realized by the simple expedient of providing one or more layers in the multilayer interference filter on the display window with a decreasing center-to-edge thickness gradient and increasing the optical absorption of the layers. Since the filter layer is thicker in the center than at the edges, the attenuation of light output of the CRT by these layers is greatest at the center and gradually decreases toward the edges of the window.

The thickness gradient needed can be achieved using a point source of material for the deposition as shown diagrammatically in FIG. 3. As is known, the distribution of material from such a point source P, within the area of direct flux $F_d$, tends to be concentrated in the center of the substrate 30, and to fall off more or less gradually toward the edges, as indicated schematically by the concentric arcs a through c, resulting in a filter layer 32 with a decreasing thickness from center to edge of the substrate. As is also known, the degree of fall off can be controlled to a certain extent by adjusting the conditions of deposition, for example the distance between the point source and the substrate, the rate of deposition, and the partial pressure of gas within the deposition atmosphere. While this effect is seen for flat substrate surfaces, such as shown in FIG. 3, it is somewhat enhanced for convexly curved surfaces of the type sometimes employed in the display windows of monochrome cathode ray tubes for color projection televisions.

Figure 4:
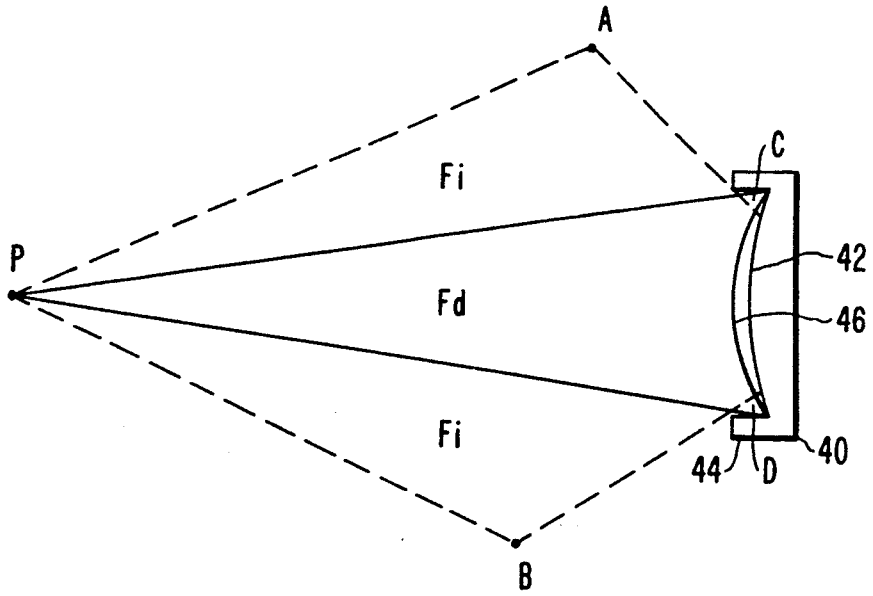
FIG. 4 is a diagrammatic view including a cross-section similar to that of FIG. 2*a* for another arrangement for depositing a filter layer on a display window in accordance with the invention.

Thickness gradient can also be achieved using a skirt surrounding the display window in order to shadow the peripheral regions of the display window surface from vapor particles approaching the surface at low angles, for example, those scattered off other particles present in the deposition atmosphere. Such a condition is shown diagrammatically in FIG. 4 wherein display window 40, having a convexly curved inner surface 42, also has an integral upstanding peripheral sidewall 44, often referred to as the display window "skirt". Material from point P, such as vapor obtained by heating a source of material, can either reach the surface 42 directly within the area of direct flux $F_d$, or indirectly from points outside this area, for example scattering from points A and B. Since these points are outside the area of direct flux $F_d$, material reaching the substrate from these points cannot be deposited in the peripheral areas C and D of surface 42, due to shadowing by skirt 44. Thus, a deposited layer 46 tends to have a decreasing thickness from the center toward the edges of the substrate surface 42. The areas of indirect flux are indicated in FIG. 4 as $F_i$. This shadowing effect can also be achieved using removable skirts or baffles which are not an integral part of display window 40. In addition, such removable skirts or baffles can be used in combination with the integral skirt 44 in order to enhance the shadowing effect and obtain a desired thickness distribution.

Other techniques for obtaining the desired thickness gradient include the use of stationary or movable dodgers, in conjunction with a stationary or moving substrate. The motion may be linear, circular or "planetary", that is, moving in a circular path while rotating about its normal axis. As is know, such planetary motion tends to result in a more symmetrical distribution of deposited layers.

Of course, any of these techniques may be combined to enhance the desired effect. For example, deposition from a point source can be combined with the use of a skirt, to increase the degree of fall off of the deposit towards the edges of the display window.

The increased optical absorption of the layer, preferably the first layer deposited, can be obtained by altering the conditions under which the layer is deposited and/or by subsequently treating the deposited layer, e.g., to alter its chemical composition. Preferably, the multilayer interference filter is composed of alternating layers of metallic oxides having low and high indices of refraction, such as, for example, $SiO_2$ and $TiO_2$, and the layers are formed reactively by deposition of the metal in the presence of oxygen. Since the optical absorption of such layers increases with decreasing oxygen content, the desirable increase in optical absorption may be readily obtained either by depriving the vapor deposition atmosphere of oxygen during deposition, or alternatively by heating the reacted layer in a reducing atmosphere, or by a combination of these techniques.

Figure 6:
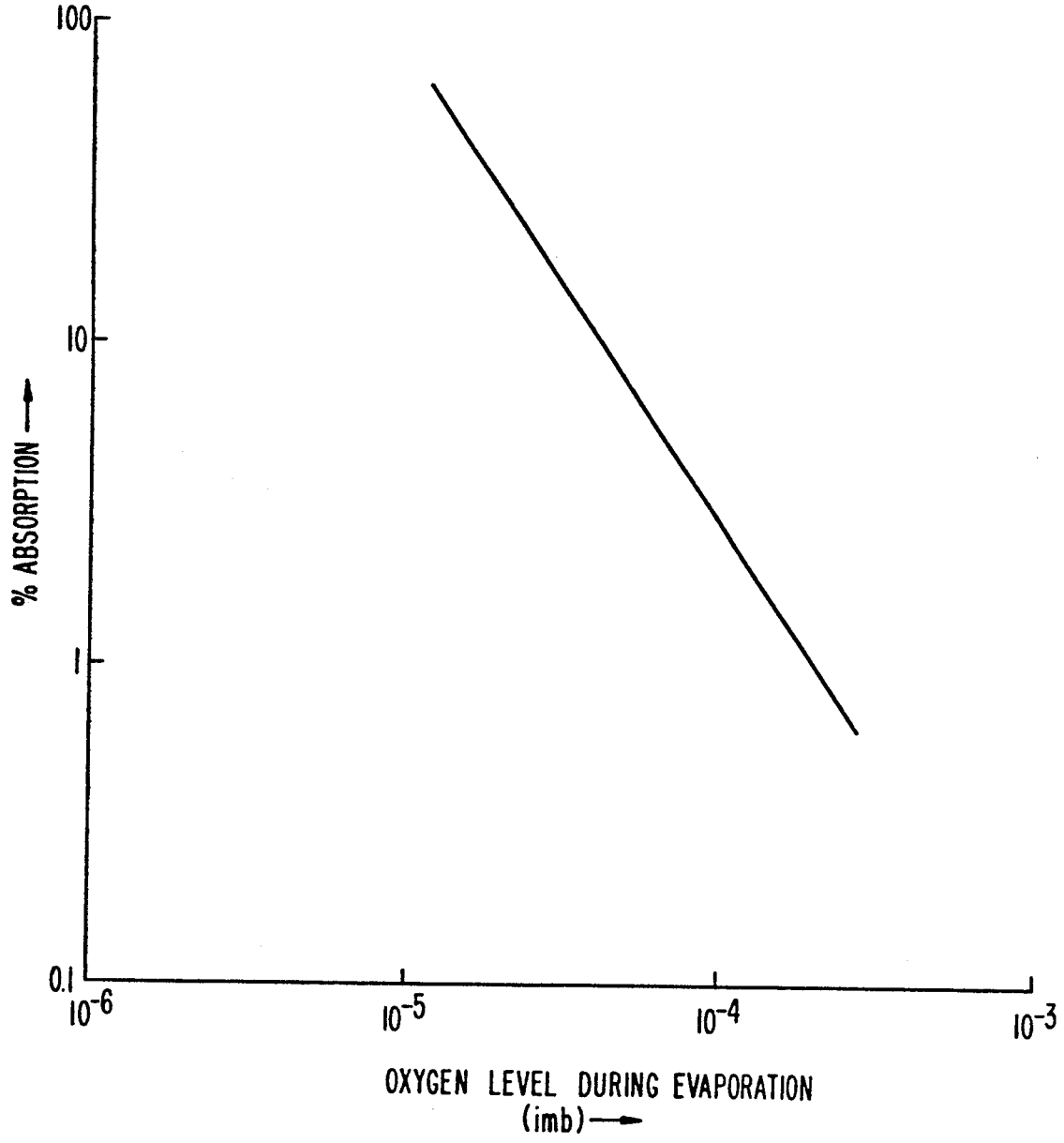
FIG. 6 is a graph of optical absorption (%) of a vapor deposited metal oxide layer versus oxygen partial pressure (millibars) in the vaporizing atmosphere.

FIG. 6 shows the effect of reduced oxygen content of the deposited layer on optical absorption, as indicated by the reduced partial pressure of oxygen in the vapor deposition atmosphere. For example, an order of magnitude reduction of oxygen partial pressure from $10^{-4}$ to $10^{-5}$ millibars increases optical absorption from 5 to 80 percent.

As would be expected, higher absorption give greater degrees of correction, but of course, also cause a correspondingly greater reduction in luminance output of the tube.

Other techniques for increasing the optical absorption of the layers include uniformly darkening or tinting the layers to achieve a neutral density or color filter.

A conventional three-tube color projection television device is shown diagrammatically in FIG. 5, employing a rear projection screen. Video signals are received by television receiver circuits 140 and are projected through individual red, green and blue cathode ray tube (CRT)/lens projector assemblies 16, 18 and 20, onto the rear surface 22 of projection screen 120. The three CRT/lens projector assemblies 16, 18 and 20 each include a CRT and associated projection optics, and are arranged horizontally with respect to screen 120. The green assembly 18 is located so as to have its optical axis 26 coincide with the central projection axis, while the red and blue assemblies 16 and 20 having optical axis 24 and 28 respectively, are laterally and angularly offset from the green axis 26.

In accordance with the invention, one or more of the CRTs has a multi-layer interference filter with one or more darkened or tinted filter layers for reduced bulls-eye effect on the projection screen image. While correction of less than all of the tubes can have an adverse effect upon the white field uniformity of the projection image, it is recognized that other techniques for reducing the bulls-eye effect can be used in combination with the present invention, for example, as described in my copending U.S. patent application Ser. No. 459,915, filed Jan. 2, 1990, or copending U.S. patent application Ser. No. 289,338, U.S. Pat. No. 4,914,510, filed Dec. 23, 1988 and assigned to North American Philips Corporation.

What is claimed is:

1. A monochrome cathode ray tube for projection television, the tube having a luminescent output and comprising in an evacuated envelope: a display screen on an inner surface of a display window in the wall of the envelope, the display screen comprising a layer of a luminescent material; and a multilayer interference filter overlying the display screen, characterized in that one or more of the layers of the filter has a center-to-edge thickness gradient in which the thickness decreases from center to edge of the display window, and further characterized in that the optical absorption of the one or more of the layers, for at least the wavelengths of radiation corresponding to the luminescent output of the tube, is greater than that of the remaining layers of the filter, thereby providing greater attenuation of the emitted radiation in the center and progressively less attenuation toward the edges of the display window, thereby to improve the luminance uniformity of the tube.

2. The tube of claim 1 in which the inner surface of the display window is convexly curved.

3. The tube of claim 1, in which one of the one or more layers having greater optical absorption is the layer in contact with the display window.

4. The tube of claim 1, in which the attenuation takes place over a range of wavelengths including the red, blue and green portions of the visible spectrum.

5. The tube of claim 1, in which the attenuation takes place over a range of wavelengths corresponding to those of the luminescent output of the tube.

6. The tube of claim 1 in which the filter layers comprise metallic oxides and the one or more layers having greater optical absorption are oxygen-deficient.

7. The tube of claim 1 in which the display window has an integral skirt and all of the filter layers have a decreasing center-to-edge thickness gradient.

8. A three tube color projection television display device having monochrome cathode ray display tubes with luminescent outputs having wavelengths of radiation in red, blue and green, respectively, the tubes each comprising in an evacuated envelope a display screen on the inner surface of a display window in the wall of the envelope, said display screen comprising a layer of a luminescent material, and at least one of the tubes also having a multilayer interference filler between the luminescent material layer and the display window, characterized in that at least one of the tubes having the filter includes one or more filter layers having a center-to-edge thickness gradient in which the thickness decreases from center to edge of the display window, and having an optical absorption, at least for the wavelengths of radiation corresponding to the luminescent output of the tube, greater than that of the remaining layers of the filter, thereby providing greater attenuation of the emitted radiation in the center and progressively less attenuation toward the edges of the display window, thereby to improve the luminance uniformity of the tube.

9. The display device of claim 8 in which the inner surface of the display window of each of the tubes with interference filter is convexly curved.

10. The display device of claim 8 in which all three of the tubes each have a multilayer interference filter on the inner surface of the respective display windows of the tubes, and all three tubes include the one or more layers with increased optical absorption.

11. The display device of claim 10 in which the inner surface of the display window of each of the three tubes is convexly curved.

12. A method of producing a monochrome cathode ray display tube, the tube comprising in an evacuated envelope a display screen on the inner surface of a display window in the wall of the envelope, and a multilayer interference filter in contact with the display window under the display screen, the method comprising the steps of:

depositing one or more of the layers of the multi-layer interference filter with a center-to-edge thickness gradient in which the thickness of the layer decreases from the center to the edge of the display window, and increasing the optical absorption of the layer relative to the other layers of the interference filter for at least the wavelengths of radiation corresponding to the luminescent output of the tube, thereby providing greater attenuation of the emitted radiation in the center and progressively less attenuation toward the edges of the display window, to improve the luminance uniformity of the tube.

13. The method of claim 12 in which the center-to-edge thickness gradient is achieved by shadowing the peripheral regions of the display window of the cathode ray tube during deposition.

14. The method of claim 12 in which the multi-layer interference filter layers consist of metallic oxides, and the optical absorption of the one or more layers is increased by reducing the oxygen content of the layer.

15. The method of claim 14 in which the multi-layer interference filter layers are formed by reaction of metal vapor with oxygen during deposition, and the optical absorption of the one or more layers is increased by depriving such layers of oxygen during deposition.

16. The method of claim 12 in which the optical absorption of the layer in contact with the display window is increased.

17. The method of claim 12 in which the center-to-edge thickness gradient is achieved by evaporating from a point source.

18. The method of claim 17 in which the inner surface of the display window is convexly curved.

* * * * *